US005125385A

United States Patent [19]

Frinzel

[11] Patent Number: 5,125,385

[45] Date of Patent: Jun. 30, 1992

[54] TANK VENTILATION SYSTEM AND METHOD FOR OPERATING THE SAME

[75] Inventor: Udo Frinzel, Grünthal, Fed. Rep. of Germany

[73] Assignee: Siemens Aktiengesellschaft, Munich, Fed. Rep. of Germany

[21] Appl. No.: 684,605

[22] Filed: Apr. 12, 1991

[30] Foreign Application Priority Data

Apr. 12, 1990 [EP] European Pat. Off. ..... 90107017.7

[51] Int. Cl.[5] ..... F02M 51/00

[52] U.S. Cl. ..... 123/698; 123/520

[58] Field of Search ..... 123/489, 520

[56] References Cited

U.S. PATENT DOCUMENTS

| | | | |
|---|---|---|---|
| 4,763,634 | 8/1988 | Morozumi | 123/520 |
| 4,831,992 | 5/1989 | Jundt et al. | 123/520 |
| 4,949,695 | 8/1990 | Uranishi et al | 123/520 |
| 4,961,412 | 10/1990 | Furuyama | 123/520 |
| 4,962,744 | 10/1990 | Uranishi et al. | 123/520 |
| 4,967,713 | 11/1990 | Kojima | 123/520 |
| 5,044,341 | 9/1991 | Henning et al. | 123/489 |

FOREIGN PATENT DOCUMENTS

| | | | |
|---|---|---|---|
| 0191170 | 8/1986 | European Pat. Off. | 123/520 |
| 3624441 | 1/1988 | Fed. Rep. of Germany | 123/520 |
| 2607192 | 5/1988 | France | 123/489 |
| 6140437 | 2/1986 | Japan | 123/489 |
| 9000225 | 1/1990 | PCT Int'l Appl. | 123/520 |

*Primary Examiner*—Raymond A. Nelli

*Attorney, Agent, or Firm*—Herbert L. Lerner; Laurence A. Greenberg

[57] ABSTRACT

A tank ventilation system for an internal combustion engine includes a lambda control device and an intake section communicating with the engine; a throttle valve in the intake section and air flow rate meter in the intake section for determining a flow rate of air aspirated by the engine; a tank communicating with a reservoir for holding fuel vapors; a scavenging line communicating between the reservoir and the intake section downstream of the throttle valve to be scavenged by means of a scavenging air mass; a tank ventilation valve in the scavenging line for controlling the scavenging air mass; a control unit for triggering the tank ventilation valve during a scavenging event in given operating states of the engine; and a delivery line communicating between the reservoir and the intake section between the throttle valve and the air flow rate meter for delivering the scavenging air mass to the reservoir. A method for operating the system includes opening the tank ventilation valve with the control unit during a first scavenging event after starting the engine, resulting in a lambda deviation $d\lambda$; measuring a scavenging air flow rate $\dot{Q}$ with the air flow rate meter; and calculating a scavenging fuel flow rate $\dot{K}$ from the lambda deviation $d\lambda$ and the scavenging air flow rate $\dot{Q}$ as a measure of the loading of the reservoir, according to the equation $\dot{K}=\dot{Q}/d\lambda$. The method may also include checking upon each triggering of the tank ventilation valve whether or not the air flow rate measured by the air flow rate meter varies accordingly, and generating a defect signal if the measured air flow rate does not vary accordingly.

7 Claims, 2 Drawing Sheets

TANK VENTILATION SYSTEM AND METHOD FOR OPERATING THE SAME

The invention relates to a tank ventilation system for an internal combustion engine and a method for operating the same, which includes a lambda control device and an intake section, in which a throttle valve and an air flow rate meter for determining a flow rate of air aspirated by the engine are provided, a reservoir communicating with the tank for holding fuel vapors, a scavenging line through which the reservoir communicates with the intake section downstream of the throttle valve and is scavenged by means of a scavenging air mass, a tank ventilation valve in the scavenging line for controlling the scavenging air mass, and a control unit that triggers the tank ventilation valve during a scavenging event, in certain operating states of the engine.

In such systems, an activated charcoal filter that receives the fuel vapors occurring in the tank serves as a reservoir. The activated charcoal filter communicates through a scavenging, flushing or purging line with the intake track of the internal combustion engine downstream of the throttle valve. The activated charcoal filter is open to the atmosphere on one side, so that if a tank ventilation valve located in the scavenging line is opened, atmospheric air is drawn through the activated charcoal filter by the negative pressure prevailing in the intake section, and the fuel vapors are thus flushed out. The opening of the tank ventilation valve is determined by a control unit, which performs the scavenging of the activated charcoal filter only in certain engine operating states. One such system is described in European Pat. No. 0 191 170, for example.

A problem in such tank ventilation systems is that the flow rate of scavenging air aspirated from the atmosphere, and the proportion of fuel contained therein, are not known. The fuel-air mixture additionally supplied to the engine adulterates the fuel-air mixture optimally set by the engine control. The adulteration is detected by the lambda sensor and accordingly compensated for by the lambda control. However, until the compensation by the lambda control takes place, the exhaust gas performance is worse during each scavenging process.

It is accordingly an object of the invention to provide a tank ventilation system and a method for operating the same, which overcome the hereinafore-mentioned disadvantages of the heretofore-known methods and devices of this general type and which do so in such a way that the quantity of fuel-air mixture additionally present as a result of the scavenging process can be estimated, without requiring additional measuring instruments.

It is a further object of the invention to provide a simple manner for diagnosing the functioning of the tank ventilation system.

With the foregoing and other objects in view there is provided, in accordance with the invention, a tank ventilation system for an internal combustion engine, comprising a lambda control device communicating with an engine; an intake section communicating with the engine; a throttle valve disposed in the intake section; an air flow rate meter disposed in the intake section for determining a flow rate of air aspirated by the engine; a reservoir; a tank communicating with the reservoir for holding fuel vapors; a scavenging line communicating between the reservoir and the intake section downstream of the throttle valve to be scavenged by means of a scavenging air mass; a tank ventilation valve disposed in the scavenging line for controlling the scavenging air mass; a control unit for triggering the tank ventilation valve during a scavenging event in given operating states of the engine; and a delivery line communicating between the reservoir and the intake section between the throttle valve and the air flow rate meter for delivering the scavenging air mass to the reservoir.

According to the invention, the scavenging air flow rate for scavenging the activated charcoal filter is no longer drawn directly from the atmosphere, but rather through a delivery line from the intake section between the throttle valve and the air flow rate meter. The scavenging air flow rate can thus be directly determined through the existing air flow rate meter. That is, if the tank ventilation valve is opened, causing a scavenging air mass to flow through the activated charcoal filter, this scavenging air mass must first pass through the air flow rate meter. Accordingly, a change in the measured air flow rate takes place, which under steady-state engine operation conditions is directly equivalent to the scavenging air mass.

Once the exact scavenging air flow rate and the lambda deviation resulting from the scavenging process are known, the exact mass of fuel to be added and thus the burden on the activated charcoal filter, can then be ascertained.

Although the lambda deviation does briefly make for a worse exhaust gas composition, nevertheless this process need be performed only once. That is, once the burden on the activated charcoal filter is known, the further course of the load thereon can be estimated as a function of the ambient air temperature, the duration of the individual scavenging processes, and the opening of the tank ventilation valve controlled thereby. Since a sensor for detecting the ambient air temperature is typically provided in vehicles having engine control systems, no additional sensor is necessary.

For all further scavenging processes, the scavenging mixture is thus known from the burden on the activated charcoal filter and the scavenging air flow rate measured through the air flow rate meter. Adulterations resulting from the scavenging air mixture delivered to the engine can therefore be compensated for, so that in the various scavenging processes no further lambda deviation occurs.

The invention also affords a simple option for the functional monitoring of the tank ventilation system that is prescribed by law in some countries. Each time it is triggered, that is each time the tank ventilation valve is opened or closed, the flow rate of air measured by the air flow rate meter must vary accordingly. On the other hand, if the tank ventilation valve remains stuck in some position when triggered, this shows that no change in the air flow rate has occurred.

In accordance with another feature of the invention, there is provided a check valve in the delivery line for the scavenging air mass. This check valve is seated directly at the tapping point of the intake section. It makes it possible for a mass to flow only in the direction toward the activated charcoal filter.

This check valve assures that if there is leakage or a break in the delivery line, no adulterating air will reach the intake section.

In accordance with a further feature of the invention, in order to assure the flow out of the tank which is necessary for loading the activated charcoal filter with fuel vapors, the check valve is bypassed by a suitably dimensioned bypass line. The same effect can be attained if a check valve having a defined leakage air quantity is used instead of the bypass line.

Another advantage of the invention is that even if there is a total failure of the tank ventilation system, no fuel vapors will reach the atmosphere. In a conventional system, with an activated charcoal filter that is open on one side, fuel escapes to the open air if the loading capacity of the activated charcoal filter is exceeded.

In contrast, in the system according to the invention, this fuel is retained in the delivery line. In accordance with an added feature of the invention, an overload of the delivery line from pressure building up is prevented by the bypass line or by the check valve having a defined leakage air quantity. In an extreme case, fuel can accordingly at most reach the intake section.

With the objects of the invention in view, there is also provided a method for operating a tank ventilation system for an internal combustion engine, which comprises opening the tank ventilation valve with the control unit during a first scavenging event after starting the engine, resulting in a lambda deviation $d\lambda$; measuring a scavenging air flow rate $\dot{Q}$ with the air flow rate meter; and calculating a scavenging fuel flow rate $\dot{K}$ from the lambda deviation $d\lambda$ and the scavenging air flow rate $\dot{Q}$ as a measure of the loading of the reservoir, according to the equation $\dot{K}=\dot{Q}/d\lambda$.

In accordance with another mode of the invention, there is provided a method which comprises calculating the scavenging fuel flow rate to be expected upon further scavenging events from the time since the last scavenging event and a measured ambient temperature, on the basis of the scavenging fuel flow rate ascertained in the preceding scavenging event.

With the objects of the invention in view, there is additionally provided a method for operating a tank ventilation system for an internal combustion engine, which comprises checking upon each triggering of the tank ventilation valve whether or not the air flow rate measured by the air flow rate meter varies accordingly, and generating a defect signal if the measured air flow rate does not vary in this process.

Other features which are considered as characteristic for the invention are set forth in the appended claims.

Although the invention is illustrated and described herein as embodied in a tank ventilation system and a method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
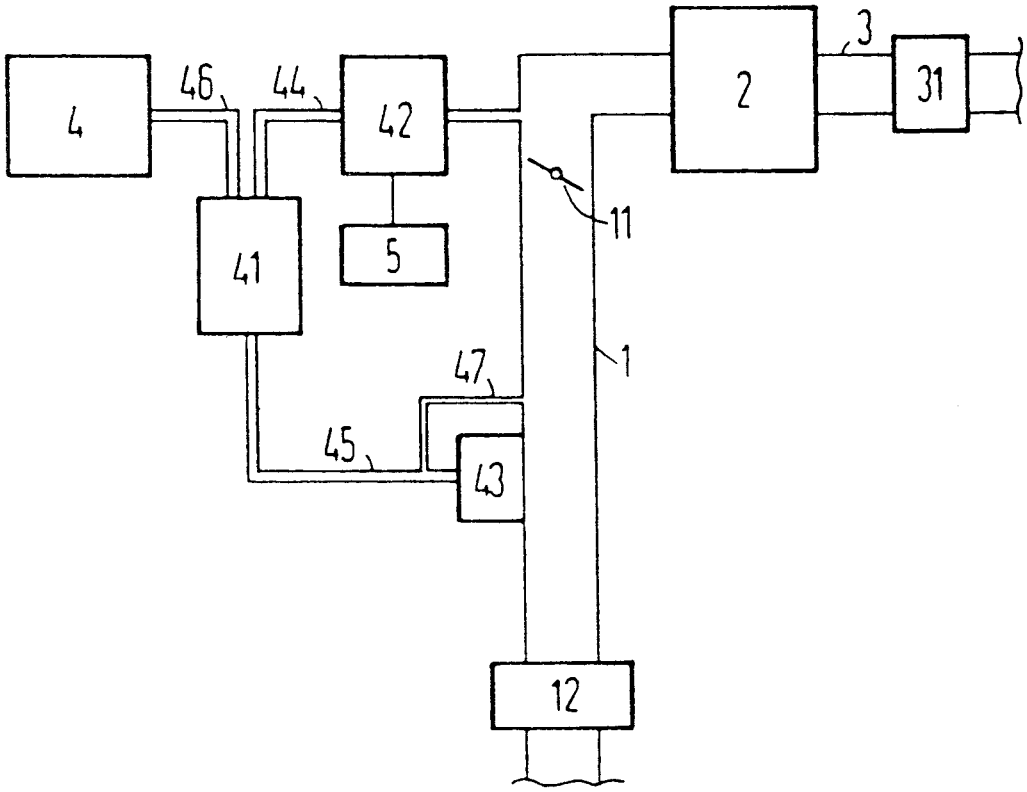
FIG. 1 is a schematic and block circuit diagram of a tank ventilation system according to the invention.

Referring now to the figures of the drawings in detail and first, particularly, to FIG. 1 thereof, there is seen an intake section 1 of an internal combustion engine. Inflowing air passes through an air flow rate meter 12 and a throttle valve 11 before entering an engine 2. The engine 2 is adjoined by an exhaust section 3, in which a lambda sensor or probe 31 is installed to measure exhaust gas.

The air flow rate meter 12 and the lambda sensor 31 are connected to an engine control system 20. The engine control system controls an ignition and injection system for the engine.

A tank 4 communicates over a connecting line 46 with a reservoir in the form of an activated charcoal filter or canister 41. As a result, fuel vapors that occur in the tank 4 are stored in the activated charcoal filter 41. In order to scavenge, purge or flush the activated charcoal filter 41, the filter communicates through a scavenging line 44 and a tank ventilation valve 42 with the intake section 1, downstream of the throttle valve 11. A delivery line 45 connects the activated charcoal filter 41 to the intake section 1 between the throttle valve 11 and the air flow rate meter 12. A check valve 43 is provided at the connection point of the delivery line 45 to the intake section 1 and is bypassed by a small bypass line 47. The tank ventilation valve 42 is electrically actuatable and is triggered by a control unit 5.

The functioning of the device will be explained below, while referring to the flow chart of FIG. 2. After starting the engine, the loading of the activated charcoal filter, in other words, the quantity of fuel vapors stored therein, is unknown. This loading is therefore ascertained upon the first scavenging process.

The engine control system defines the time for this first possible scavenging process, whenever an uncritical engine operating state, in which the additionally introduced scavenging mixture does not cause overly great operational disturbances, has been reached for the first time.

In a step S1 the tank ventilation valve 42 is then opened to a certain opening cross section by the control unit 5. A flow therefore develops through the delivery line 45, the activated charcoal filter 41 and the scavenging line 44 with the tank ventilation valve 42, due to the pressure drop upstream and downstream of the throttle valve 11. This system of lines acts as a bypass line of the intake section 1, so that the effective throttle cross section is thus increased, and the quantity of air aspirated through the air flow rate meter 12 also increases. In steady-state operation of the engine, the increase in the air flow rate, as measured at the air flow rate meter 12, is therefore equal to the scavenging air flow rate $\dot{Q}$ that flows through the activated charcoal filter 41.

Depending on the loading of the activated charcoal filter 41 with fuel vapors, this scavenging air mass is more or less enriched with fuel to make a scavenging mixture. This scavenging mixture reaches the engine 2 through the scavenging line 44, in addition to the operating mixture that has been established through the engine control system.

Depending on the composition of the scavenging mixture, different effects arise. If the activated charcoal filter 41 is empty or only lightly loaded, then the scavenging mixture is formed of air or a substoichiometric mixture, and a lambda deviation in the direction of a lean mixture results. If the load stored in the activated charcoal filter 41 is precisely a stoichiometric scavenging mixture, then no lambda deviation will occur. However, if the activated charcoal filter 41 is very heavily loaded with fuel vapors, the result is a superstoichiometric scavenging mixture, and a lambda deviation in the direction of a rich mixture occurs.

Figure 2:
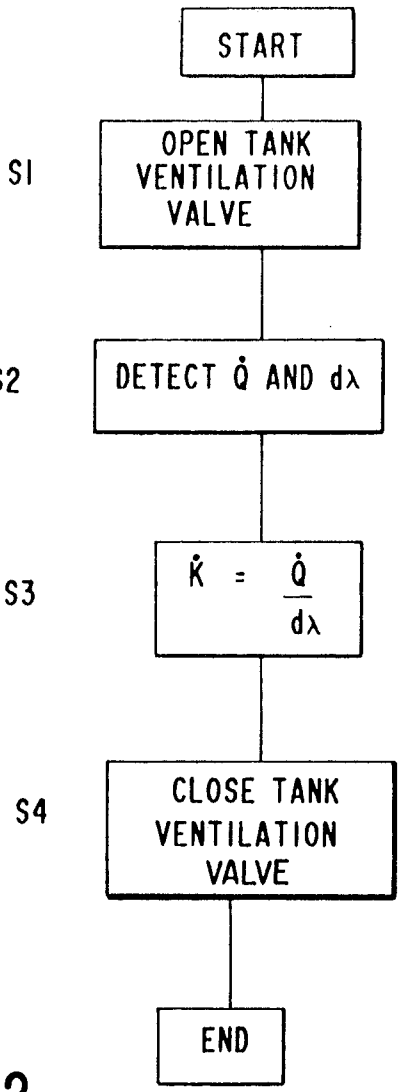
FIG. 2 is a flow chart used to explain the method in a first scavenging process.

In a step S2 of FIG. 2, this lambda deviation $d\lambda$ and the scavenging air flow rate $\dot{Q}$ are detected. Then, in a step S3, the quantity of scavenging fuel $\dot{K}$ flushed out of the activated charcoal filter 41 is calculated. This scavenging fuel flow rate $\dot{K}$ is a measure of the loading of the activated charcoal filter 41. It indicates how much fuel is flushed out of the activated charcoal filter 41, at a set opening cross section of the tank ventilation valve 42 and at the predetermined scavenging air flow rate $\dot{Q}$. Finally, in a step S4, the tank ventilation valve 42 is closed again, and the first flushing process is thus ended.

In all subsequent flushing or scavenging processes, a different method used. The loading of the activated charcoal filter 41 with fuel vapor is ascertained in the first flushing process. Since this loading does not vary suddenly but rather only varies slowly, substantially as a function of the time since the last scavenging process and of the ambient temperature, the loading can be estimated at the beginning of each further scavenging process.

Figure 3:
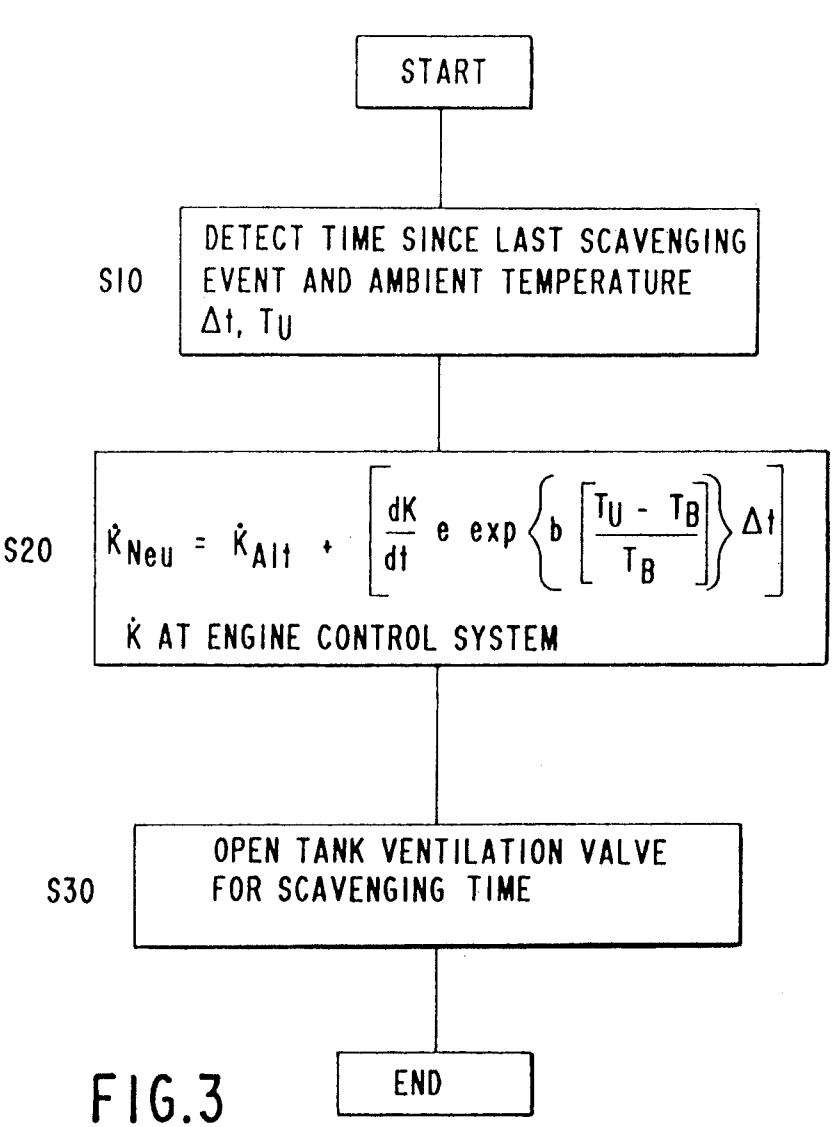
FIG. 3 is a flow chart used for explaining the method in a further scavenging processes.

In this process, the time since the last scavenging process $\Delta t$ and the ambient temperature $T_U$ are read in at a step S10 of the flow chart shown in FIG. 3. A sensor for the ambient temperature is present in the engine control system.

At a step S20, a scavenging fuel flow rate $\dot{K}_{Neu}$ to be expected in the next scavenging process is calculated from the following equation:

$$\dot{K}_{Neu} = \dot{K}_{Alt} + \left[ \frac{dK}{dt} \cdot e \exp\left\{ b \left[ \frac{T_U - T_B}{T_B} \right] \right\} \Delta t \right]$$

in which $\dot{K}_{Neu}$ = the scavenging fuel flow rate resulting during the current scavenging process;

$\dot{K}_{Alt}$ = the scavenging fuel flow rate resulting during the past scavenging process;

$dK/dt$ = the loading factor at reference temperature (dependent on tank geometry, etc.), ascertained empirically;

$$e \exp\left\{ b \left[ \frac{T_U - T_B}{T_B} \right] \right\}$$

= temperature-dependent correction factor;

b = constant (determined empirically);

$T_U$ = ambient temperature in K;

$T_B$ = reference temperature in K; and $\Delta t$ = time since the last scavenging process.

The thus-calculated value for the scavenging fuel flow rate $\dot{K}$ is then sent to the engine control system. When ascertaining the quantity of fuel to be injected, this system can take the scavenging fuel quantity being added by the scavenging process into account, so that a stoichiometric mixture ratio continues to reach the engine 2. The engine control system carries out this correction during the entire scavenging process, or in other words as long as the control unit 5 opens the tank ventilation valve (step S30).

Accordingly, no further lambda deviation occurs in the various scavenging processes, and thus there is no worsening of the exhaust gas figures.

Figure 4:
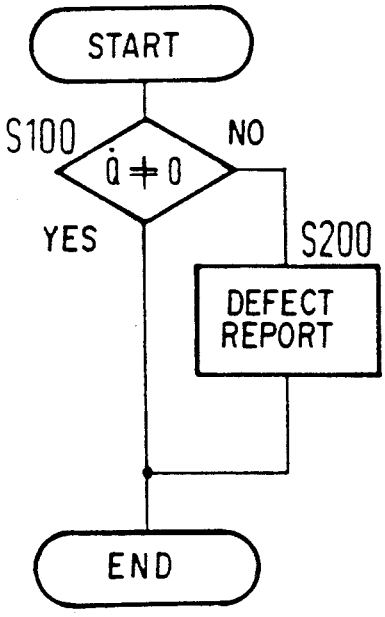
FIG. 4 is a flow chart used to explain a method for diagnosing the function of a tank ventilation valve.

In the embodiment described, the function of the tank ventilation system is also monitored in accordance with the flow chart given in FIG. 4. The program begins each time the tank ventilation valve 42 is triggered. Upon opening and closing, the scavenging air flow rate must always vary, as long as the tank ventilation system is intact. This variation is detected in a step S100 through the air flow rate meter 12. If no variation occurs, then the tank ventilation valve 42 has remained stuck despite being triggered, and a defect is reported in a step S200.

I claim:

1. A tank ventilation system for an internal combustion engine, comprising:

a lambda control device communicating with an engine;

an intake section communicating with the engine;

a throttle valve disposed in said intake section;

an air flow rate meter disposed in said intake section for determining a flow rate of air aspirated by the engine;

a reservoir;

a tank communicating with said reservoir for holding fuel vapors;

a scavenging line communicating between said reservoir and said intake section downstream of said throttle valve to be scavenged by means of a scavenging air mass;

a tank ventilation valve disposed in said scavenging line for controlling the scavenging air mass;

a control unit for triggering said tank ventilation valve during a scavenging event in given operating states of the engine; and a delivery line communicating between said reservoir and said intake section between said throttle valve and said air flow rate meter for delivering the scavenging air mass to said reservoir.

2. The tank ventilation system according to claim 1, wherein said delivery line is connected to said intake section at a given point of withdrawal, and including a check valve disposed in said delivery line at said given point of withdrawal for allowing a flow toward said reservoir in only one direction.

3. The tank ventilation system according to claim 2, including a bypass line bypassing said check valve for assuring a flow necessary for loading said reservoir.

4. The tank ventilation system according to claim 2, wherein said check valve allows a defined leakage air quantity in a closed state for assure a necessary flow for loading said reservoir.

5. In a method for operating a tank ventilation system for an internal combustion engine including:

a lambda control device controlling the air/fuel ratio of the engine; an intake section communicating with the engine; a throttle valve disposed in the intake section; an air flow rate meter disposed in the intake section for determining a flow rate of air aspirated by the engine; a reservoir; a tank communicating with the reservoir for holding fuel vapors; a scavenging line communicating between the reservoir and the intake section downstream of the throttle valve to be scavenged by means of a scavenging air mass; a tank ventilation valve disposed in the scavenging line for controlling the scavenging air mass; a control unit for triggering the tank ventilation valve during a scavenging event in given operating states of the engine; and a delivery line communicating between the reservoir and the intake section between the throttle valve and the air flow rate meter for delivering the scavenging air mass to the reservoir, the method which comprises opening the tank ventilation valve with the control unit during a first scavenging event after starting the engine, resulting in a lambda deviation $d\lambda$; measuring a scavenging air flow rate $\dot{Q}$ with the air flow rate meter; and calculating a scavenging fuel flow rate $\dot{K}$ from the lambda deviation $d\lambda$ and the scavenging air flow rate $\dot{Q}$ as a measure of the loading of the reservoir, according to the equation $\dot{K}=\dot{Q}/d\lambda$.

6. The method according to claim 5, which comprises calculating the scavenging fuel flow rate to be expected upon further scavenging events from the time since the last scavenging event and a measured ambient temperature, on the basis of the scavenging fuel flow rate ascertained in the preceding scavenging event.

7. In a method for operating a tank ventilation system for an internal combustion engine including:

a lambda control device communicating with the engine; an intake section communicating with the engine; a throttle valve disposed in the intake section; an air flow rate meter disposed in the intake section for determining a flow rate of air aspirated by the engine; a reservoir; a tank communicating with the reservoir for holding fuel vapors; a scavenging line communicating between the reservoir and the intake section downstream of the throttle valve to be scavenged by means of a scavenging air mass; a tank ventilation valve disposed in the scavenging line for controlling the scavenging air mass; a control unit for triggering the tank ventilation valve during a scavenging event in given operating states of the engine; and a delivery line communicating between the reservoir and the intake section between the throttle valve and the air flow rate meter for delivering the scavenging air mass to the reservoir, the method which comprises checking upon each triggering of the tank ventilation valve whether or not the air flow rate measured by the air flow rate meter varies accordingly, and generating a defect signal if the measured air flow rate does not vary accordingly.

* * * * *